US007533502B2

(12) United States Patent
Siegel

(10) Patent No.: US 7,533,502 B2
(45) Date of Patent: May 19, 2009

(54) ROOM DIVIDING SYSTEM

(76) Inventor: Luke Siegel, 277 E. 10th St. #3A, New York, NY (US) 10009

( * ) Notice: Subject to any disclaimer, the term of this patent is extended or adjusted under 35 U.S.C. 154(b) by 93 days.

(21) Appl. No.: 11/017,276

(22) Filed: Dec. 20, 2004

(65) Prior Publication Data

US 2005/0183356 A1 Aug. 25, 2005

Related U.S. Application Data

(60) Provisional application No. 60/531,703, filed on Dec. 22, 2003.

(51) Int. Cl.
*E06B 1/04* (2006.01)

(52) U.S. Cl. ..... 52/207; 52/204.61; 52/504.597; 52/29; 52/204.51; 52/243.1; 52/457; 52/656.4; 52/656.7

(58) Field of Classification Search ..... 52/204.61, 52/204.597, 29, 64, 204.51, 207, 243.1, 455, 52/456, 457, 656.4, 656.7; 49/504, 505, 49/501, 125; 160/199, 196.1, 200, 197, 202, 160/222

See application file for complete search history.

(56) References Cited

U.S. PATENT DOCUMENTS 369,261 A * 8/1887 Roebuck ..... 160/222
3,463,218 A * 8/1969 Byrens et al. ..... 160/135
3,677,322 A * 7/1972 Brorson et al. ..... 160/135
3,686,795 A * 8/1972 La Barge ..... 49/345
4,122,633 A * 10/1978 Holdiman ..... 49/501
4,496,201 A * 1/1985 Allgeyer ..... 312/296
4,989,381 A * 2/1991 De Block et al. ..... 52/204.51
5,272,848 A * 12/1993 Maas ..... 52/238.1
5,546,714 A * 8/1996 Kenkel ..... 52/204.5
5,603,190 A * 2/1997 Sanford ..... 52/202
5,644,881 A * 7/1997 Neilly ..... 52/455
5,775,041 A * 7/1998 Tull et al. ..... 52/455
5,802,783 A * 9/1998 Bayha ..... 52/204.5
5,894,706 A * 4/1999 Herbst ..... 52/782.1
5,908,064 A * 6/1999 Bruce ..... 160/202
5,941,031 A * 8/1999 Fullwood ..... 52/202
6,314,689 B1 * 11/2001 Hughes ..... 52/203
6,367,203 B1 * 4/2002 Graham et al. ..... 52/1
6,609,338 B2 * 8/2003 Hightower ..... 52/204.65
6,964,131 B2 * 11/2005 Herrmann et al. ..... 49/193

* cited by examiner

*Primary Examiner*—Richard E Chilcot, Jr.
*Assistant Examiner*—Chi Q Nguyen
(74) *Attorney, Agent, or Firm*—Gottlieb, Rackman & Reisman, P.C.

(57) ABSTRACT

A system of panels is described that is used as a room divider and or door. The system includes at least one panel formed of two frames sandwiching an intermediate member made of an opaque or a light transmissive glazing, the frames and intermediate member having substantially identical dimensions and being superimposed. Locking means are also provided that are used to open and close several panels in a telescopic manner.

21 Claims, 10 Drawing Sheets

ROOM DIVIDING SYSTEM

RELATED APPLICATIONS

This application claims priority to provisional application Ser. No. 60/531,703 filed Dec. 22, 2003 and incorporated herein by reference.

BACKGROUND OF THE INVENTION

A. Field of Invention

This application pertains to a dividing system for partitioning a room or closing off one side of the room or doorway and separate the room from another room or from the outside. The system includes one or more panels formed of two frames and an intermediate transparent or opaque member sandwiched therebetween.

B. Description of the Prior Art

Typically, rooms are either subdivided by a system of screens or panels. Many screens and panels have similar structures; they consist of a generally rectangular frame that provides most of the structural strength of the panel and have some sort of indentation used to hold and support a central intermediate element. In the case of screens, the intermediate member is either a stiff material, such as a grill, or a flexible material such as a mesh. On the other hand, the central element of a panel is a relatively rigid material that is frequently transparent, or at least translucent, such as a sheet of glass or plastic.

One problem with existing panels or screens is that the frame of the panel has to be strong and heavy to support the central member. However, esthetically, panels made of lighter and thinner materials are more desirable.

SUMMARY OF THE INVENTION

A system of panels is disclosed that can be used as a room divider, as a door, etc. The system includes at least one panel formed of two superimposed frames and an intermediate member sandwiched between the frames. The intermediate member is made from a transparent or translucent material. Alternatively, the intermediate member is made of an opaque member, provided, optionally with decorative cutouts. The frames and the glazing have substantially identical dimensions. Means are also provided to join the frames and the glazing into single integral unit. These locking means include holes and complementary dowels, and/or double sided tapes.

The frames can be made of wood, a wood-based composite material, a plastic material or metal tubing.

The intermediate member may be a glazing made of glass, acrylic, etc, and preferably made with design elements to enhance its esthetic aspects. In one embodiment, panels of a system have different designs which, when superimposed, create a completely new and attractive design.

Preferably, the system can also be provided with a set of hook plates and stop plates attached to the panels. These plates are constructed and arranged so that the panels can be opened and closed selectively in a telescopic action.

The system may also include wheels mounted on the panels, the wheels engaging stationary rails. The system may also be provided with channels, or other guides for controlling the lateral movement of the panels.

DETAILED DESCRIPTION OF THE INVENTION

Figure 1B:
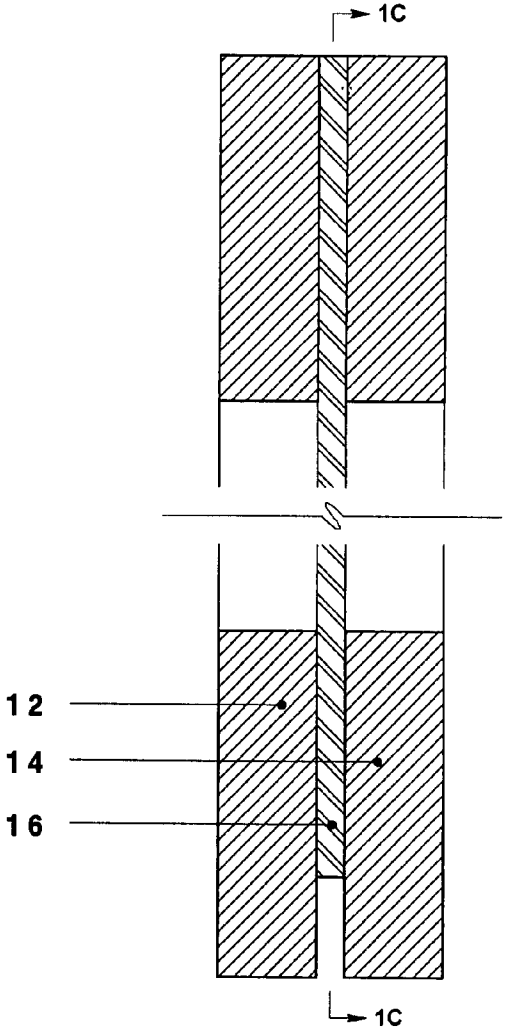
FIG. 1B shows a first enlarged side-elevational cross sectional view of the panel of FIG. 1A taken along line 1B-1B in FIG. 1A.
Figure 1A:
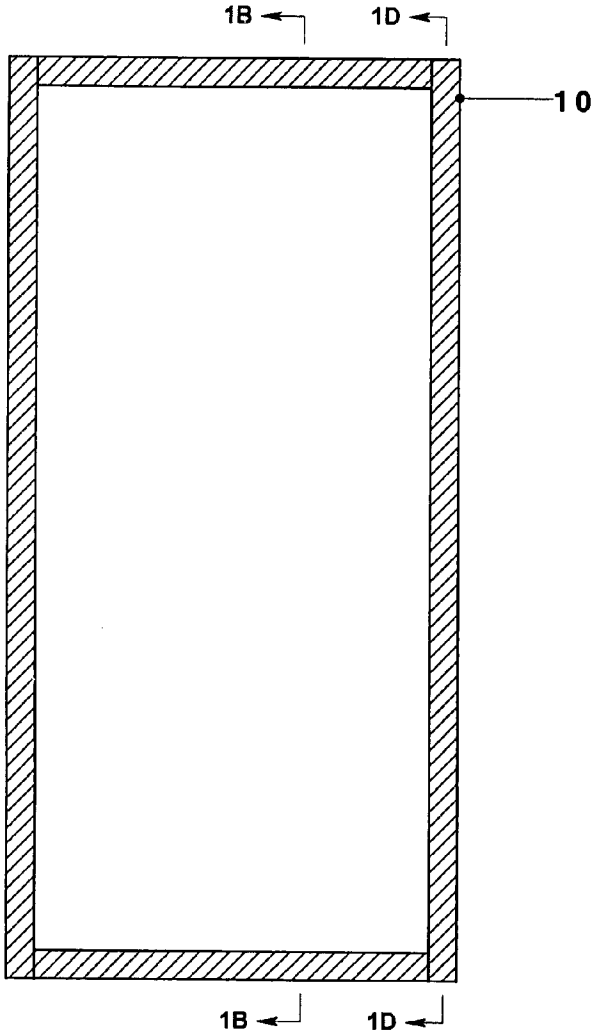
FIG. 1A shows a front elevational view of a panel constructed in accordance with this invention.
Figure 1D:
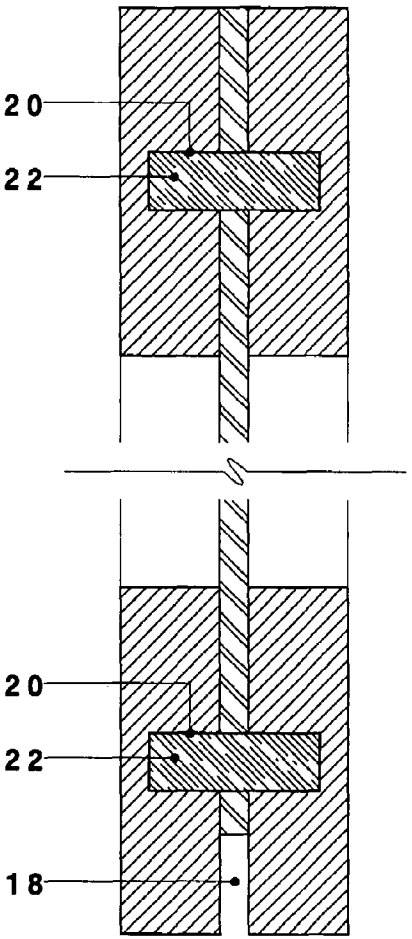
FIG. 1D shows a second enlarged side-elevational cross sectional view of the panel of FIG. 1A taken along line 1D-1D in FIG. 1A.

Referring now to the drawings, and more particularly FIGS. 1A-D, a panel 10 constructed in accordance with this invention includes a front frame 12, a back frame 14 and an intermediate glazing 16. Preferably the two frames 12, 14, are made from the same material, but they could be made of different materials as well. Some typical materials that could be used for frames 12, 14 include solid, furniture grade wood, composite wood (such as plywood that is painted or covered with a natural or artificial veneer or a laminate material) acrylic, plastic, metal (aluminum—solid or tubular—) and other similar materials. The glazing could be made of glass, but preferably it is made of a plastic material such as an acrylic. A typical frame may be about 3" wide and the panel may be about 48" wide, 96" high and 2" thick, however, it may be made to any other dimensions as well. Typically, the glazing is about ¼: thick. As shown in the drawings, these three components have substantially the same dimensions, except at the bottom where the glazing 16 may be about ⅞" shorter to form a groove 18. This groove may be used to mount the panel on a floor guide (not shown).

Figure 1C:
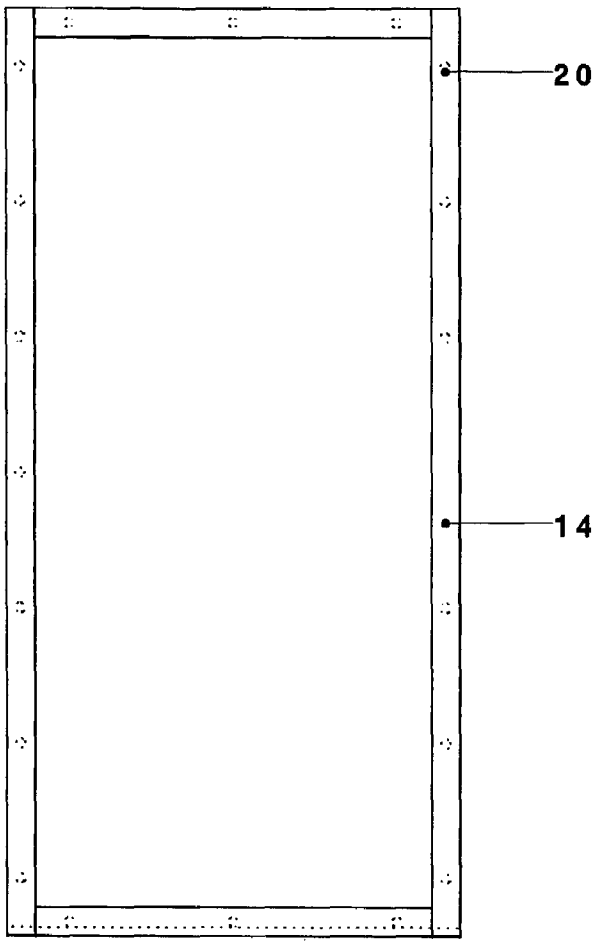
FIG. 1C shows a front elevational view of the frame member.
Figure 2:
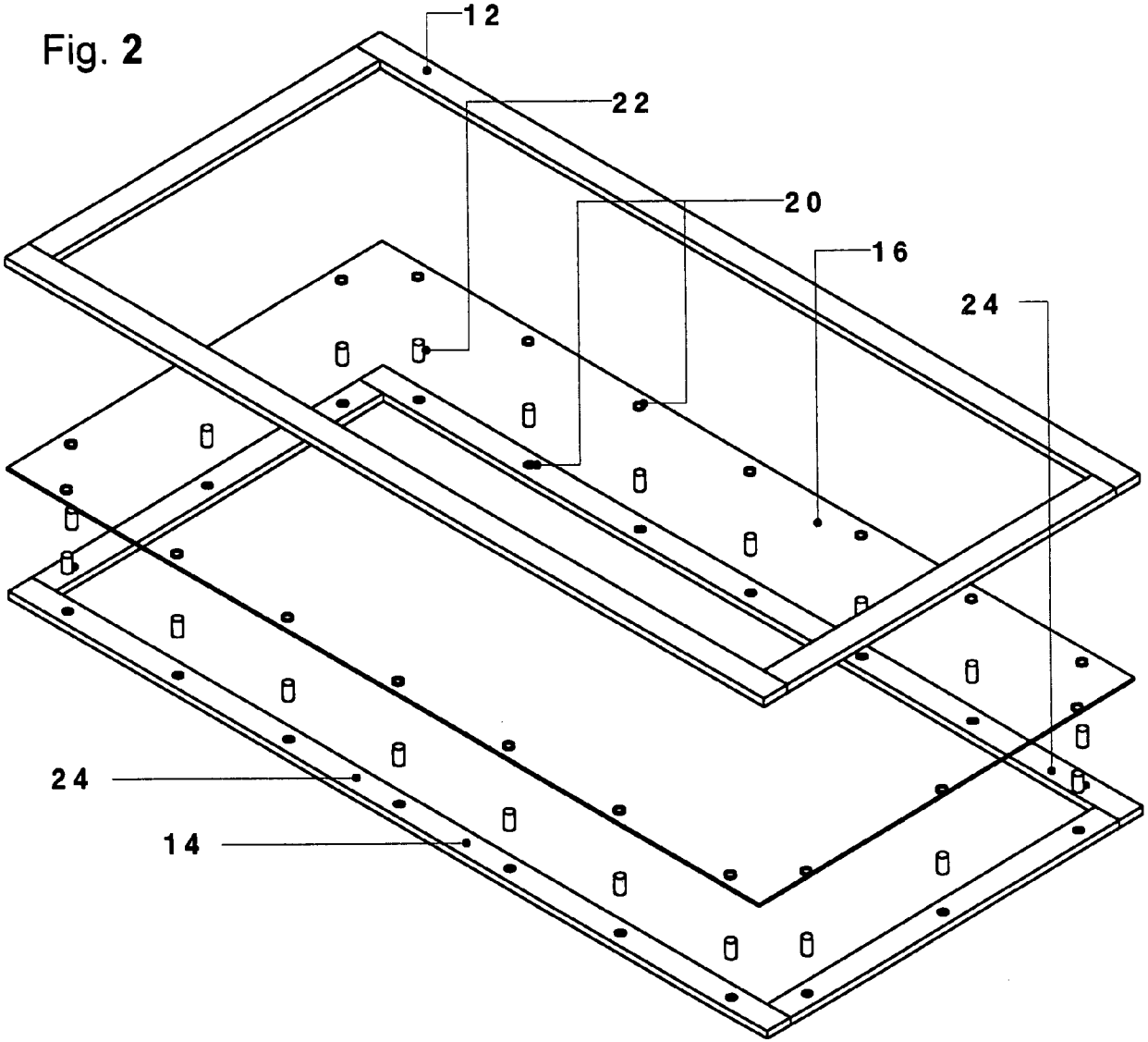
FIG. 2 shows an isometric exploded view of the panel of FIGS. 1A-1D.

As shown in FIG. 1C, on its inner surface, each frame 12, 14 and glazing 16 are formed with a plurality of holes 20 and complementary dowels 22. These holes 20 and dowels 22 are used as a means for securing the three components together. Dowels 22 can be made of wood, plastic, or other materials and typically have a diameter of ⅜ in. The dowels have several purposes: they align the frames and the glazing during assembly, and they hold the elements of the panel together. The clear double sided tape may also be used on the inner surfaces of the frames, as at 24. The tape insures that the glazing and panels do not shift with respect to each other during assembly. The tape further holds the elements of the panel together.

The panel 10 is assembled as follows. A template (not shown) is made of stiff material such as MDF and has the required dimensions and ⅜" holes made about a foot apart and 1½" from the edge. For the frames, strips are cut from standard stock. The strips are edge-banded, sanded and finished with stain and/or other coating material. Four strips are attached at right angles, or butt-joined, using for example a Hoffman joining machine, to form each frame 12, 14. The frame 14 and the glazing 16 are placed on a worktable with template disposed on top of the glazing 16. The bottom two elements are aligned and clamped to the table. The template is then used to drill holes 20 through the glazing and into the frame 14. Each hole is about ⅝" deep. The template is then reversed and used in a similar operation to drill holes in frame 12 in a mirror pattern. Alternatively, the glazing can be pre-drilled with the holes 20 and then used as the template for making the holes in the frames 12, 14.

Next, a protective cover from one side of a double sided 2¾" tape 24 is removed and the exposed tape is applied all around the frame. The portions of the tape covering holes 20 are burned out (using, for instance, a hot glue gun nozzle) and the tape is then pressed by hand causing its adhesive to wet the frame. Next, dowels 22 with some glue are inserted in all the holes 20. The protective cover from the second side of the tape is removed.

Typically, the glazing 16 is covered with a protective sheet. This sheet is now removed on one side, at least around the glazing perimeter, thus exposing the actual glazing surface. The glazing 16 is then lowered over the dowels 22 so that the glazing surface comes into contact with the tape 24 and is secured in this manner to frame 14. Next, some glue is applied to the dowels 22 and/or holes 20 in frame 12, the protective sheet from the other side of the glazing 16 is removed and tape is applied to the second frame 12. The frame 12 is then lowered over the glazing 16 thereby securing the glazing to the second frame 12 as well. In order to insure proper adhesion, the frames are pressed together by hand and by a 130 psi continuous air clamp (not shown). The air clamp squeezes all the layers together, one side at a time. It may be applied for five seconds on each side. The resulting panel 10 can be shipped, stored or hardware can be applied to it, as described below.

The panel may have other configurations as well, and may be assembled by using other techniques. For example, in one embodiment, the glazing is replaced by a core having approximately the same thickness, but being made of an opaque material, such as solid wood, composite wood, plastic or aluminum sheets, and so on. Moreover, the intermediate element is opaque, holes or cutouts may be provided therein, having different geometric shapes.

In a somewhat preferred embodiment, the panel is made by first making the required holes in the intermediate element, be it a transparent or an opaque element. The intermediate element is then used instead of a template to make the holes in the frames 12, 14.

The process for making the panel 10 could be altered in other ways as well. For example, the frames 12, 14 can be made from strips that have been mitered and then joined in a normal manner. Moreover, depending on the materials used for the frames, the frames can be painted, or covered with a low pressure molded laminate skin (not shown).

Figure 5:
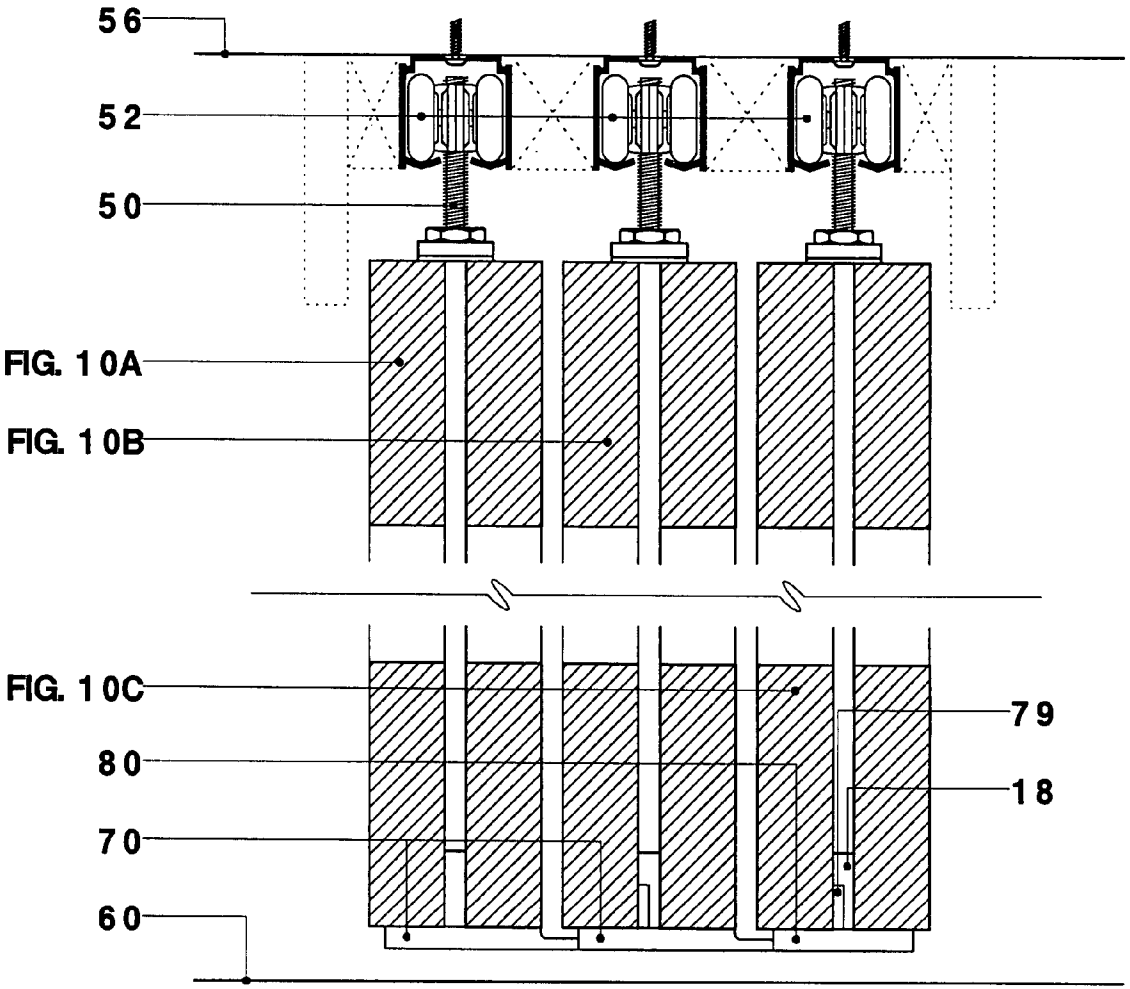
FIG. 5 shows a side sectional view of a plurality of panels in accordance with this invention.

Once the panel 10 is finished it can be used in various configurations as described in more detail below. If necessary, the panel can be hung on a standard sliding system. For example, as shown in FIG. 5, a plurality of panels 10A, 10B, and 10C can be secured to an overhead track system as follows. First, each panel 10 receives a plurality of rods 50, each rod being provided with a pair of wheels 52. Also provided are a plurality of rails 54 attached to the top wall 56 of the opening to be closed with the panels. The panels 10A-C are dimensioned so that they fit between this top wall 56 and the flooring 58. The panels can now be moved along the railings 52. They can be left floating over the flooring, and a guide bar (not shown) can be secured to the flooring so that it can extend into the groove 18.

Figures 3A, 3B, 3C:
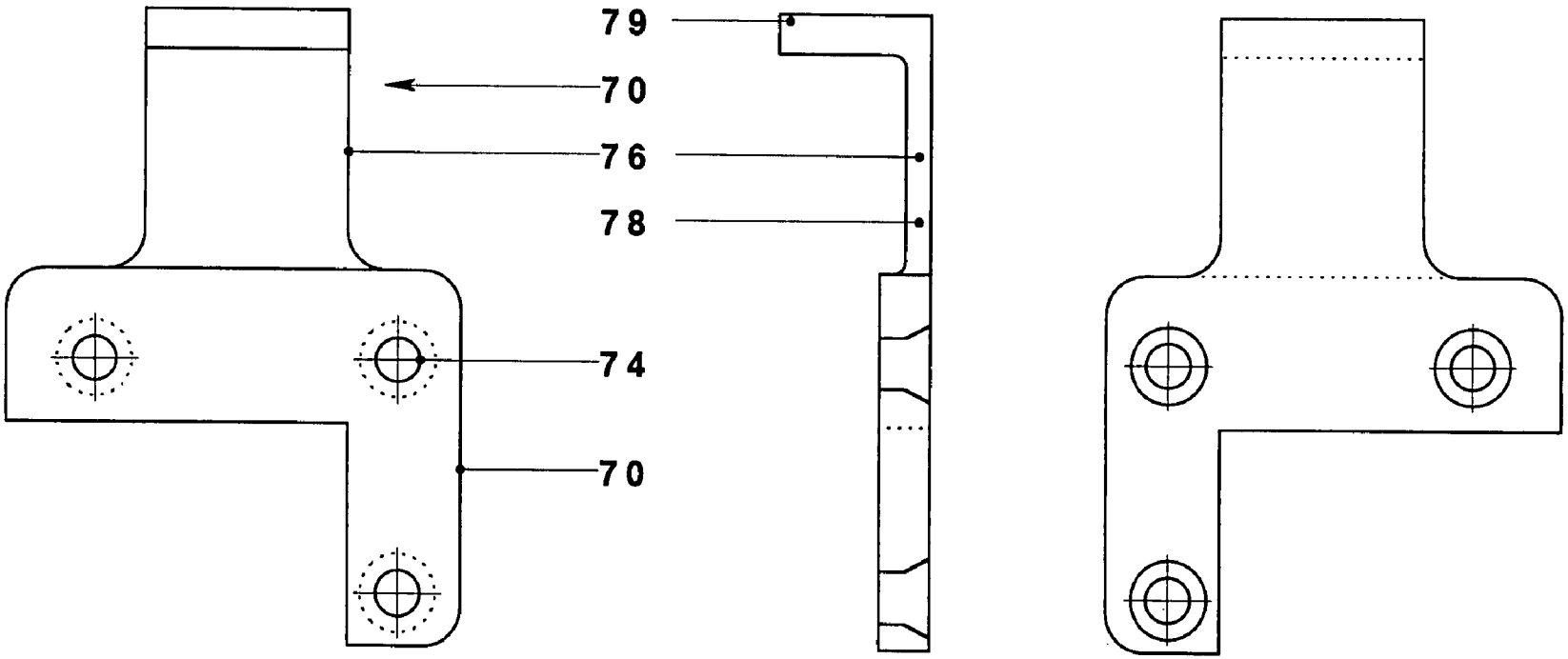
FIG. 3A shows a front elevational view of a hook plate for the panel of FIGS. 1A-D and 2.
FIG. 3B shows a side elevational view of the hook plate of FIG. 3A.
FIG. 3C shows a rear elevational view of the hook plate of FIGS. 3A and 3B.
Figure 4A:
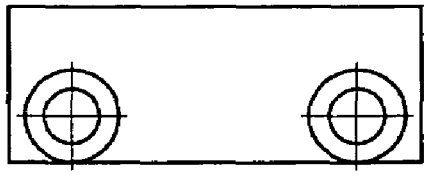
FIG. 4A shows a plan view of a stop plate used for the panel.
Figure 4B:
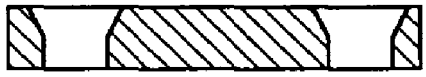
FIG. 4B shows a side sectional view of the stop plate of FIG. 4A.
Figure 4C:
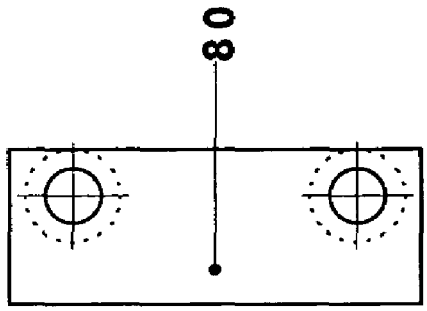
FIG. 4C shows a bottom view of the stop plate of FIGS. 4A and 4B.
Figures 6A, 6B, 6C:
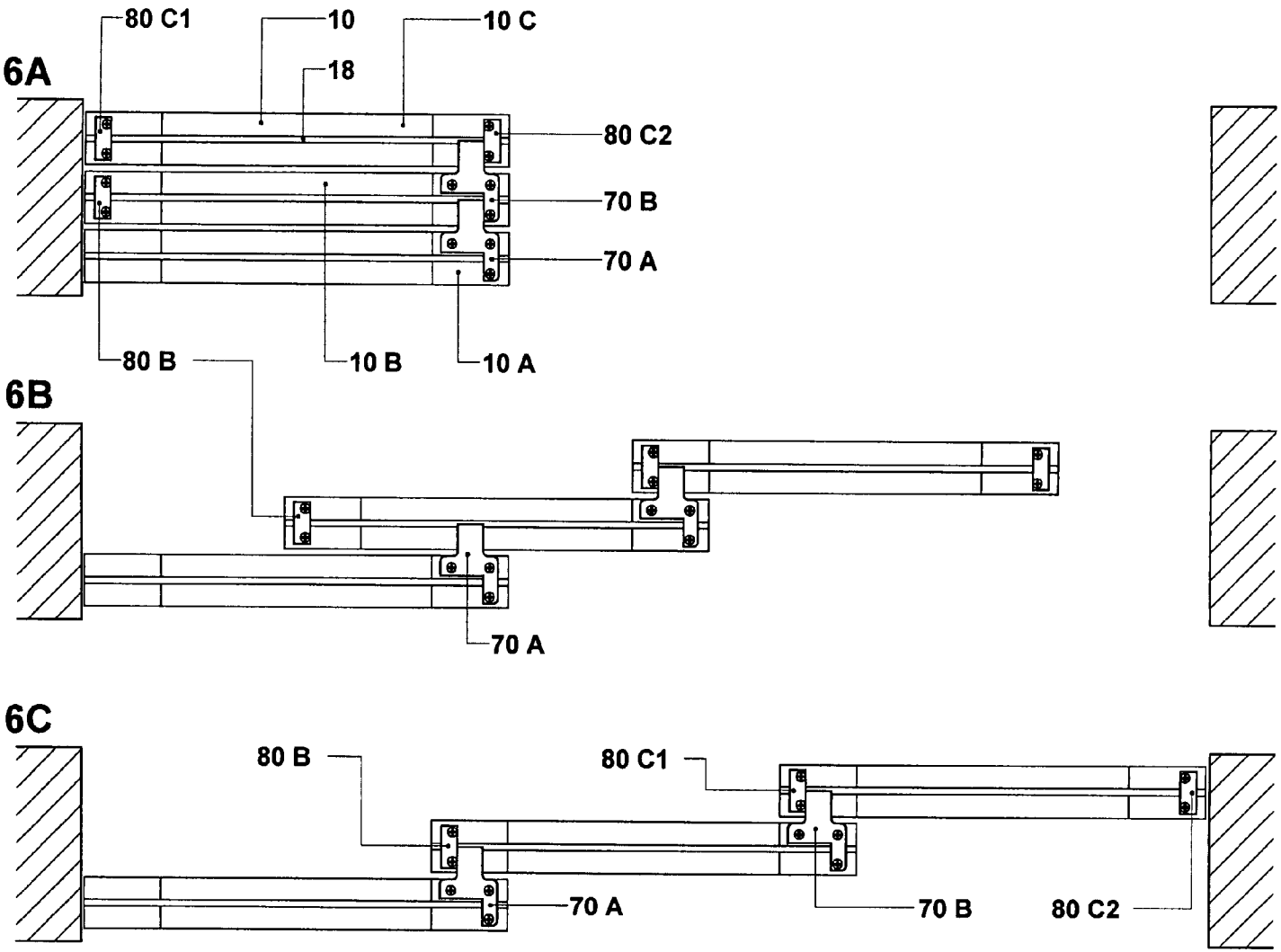
FIG. 6A shows a bottom view of a plurality of panels in the open position.
FIG. 6B shows a top view of the panels of FIG. 6A in a partially closed position.
FIG. 6C shows a top view of the panels of FIG. 6A in a completely closed position.

Alternatively, if the panels are left floating, then they can be provided with some additional hardware that interlocks the panels and allows them to be moved in a telescopic manner. The hardware to accomplish this mode of operation includes a hook-plate 70 and a stop plate 80. As shown in FIGS. 3A-3C, the hook plate 70 includes base 72 with a plurality of beveled holes 74 used to mount the hook plate 70 to the panel. Attached to the base 70, there is an arm 76 formed of an extension 78, collinear plate 72 and a member 79. As can be seen in FIG. 6A, the hook plate is attached along the bottom surface of the panels with the member 79 extending into groove 18.

Stop plates 80 have a generally rectangular shape and have two holes 82. They are also attached to the bottom of the panels 10.

The hook plate 70 and stop plate 80 is made of a ¾" by 3" cold rolled steel stock or other similar materials.

The telescoping operation is now described in conjunction with FIGS. 6A-6C. In FIG. 6A, the three panels 10A, 10B, 10C are aligned so that they completely overlap. As seen in the Figure, panel 10A has a hook plate 70A, panel 10B has a hook plate 70B and a stop plate 80B and panel 10C has two stop plates 80C1 and 80C2. This is the open or consolidated position of the panels. In this position, the hook plate 70A is abutting hook plate 70B, and hook plate 70B is abutting stop plate 80C2. Thus, base 72 on hook plate 70B acts as a stop for the hook plate 70A.

Next, system can be closed by pulling panel 10C to the right. As the panel 10C moves to the right, it is maintained stable by the member 79 riding in groove 18. The other two panels 10A, 10B remain stationary until the stop 80C1 reaches the hook plate 70B. Once stop 80C1 contacts hook plate 70B, further motion of the panel 10C to the right causes the panel 10B to start moving to the right as well, as shown in FIG. 6B. The position in FIG. 6B is a partially closed position.

The panels 10C, 10B continue moving to the right until the stop 80B contacts hook 70A. Preferably, panel 70A is anchored in place to keep it from moving. This is the closed position of the system. Each panel maintains each position and does not flop with respect to the other panels because of the engagement between member 79 of the hook plates 70 and the groove 18 of the adjacent panels.

Systems with panels constructed in this manner can be used in various configurations, and for various purposes. Moreover, systems can be made that include from one to six panels, or even more panels, depending on the size and weight of the desired design. FIGS. 7A-7D, 8A-8F , 9A-9C, 10A-

Figure 7A:
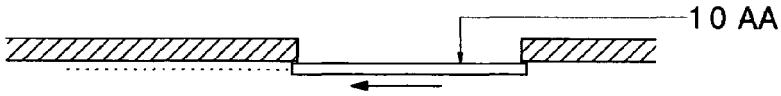
FIG. 7-A-D shows top views of typical panel systems with a single panel.
Figure 7B:
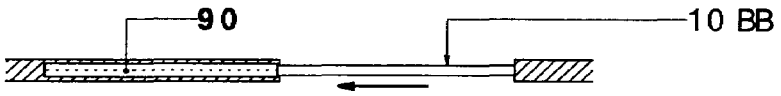
Figure 7C:
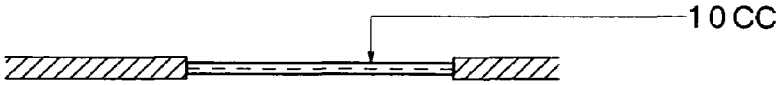
Figure 7D:
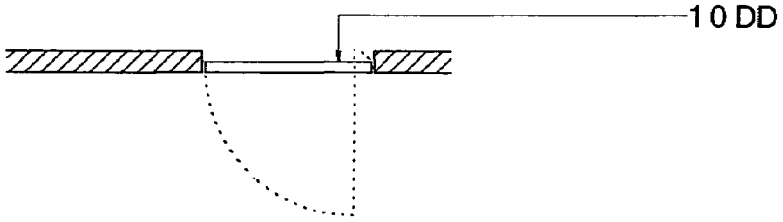

10E and 11 show just some of these systems. FIGS. 7A-7D show systems with a single panel 10AA, 10BB, 10CC, 10DD. The panel could form a sliding door (FIG. 7A), a door that fits into a pocket 90 (FIG. 7B), a fixed door (FIG. 7C), or a hinged door (FIG. 7D).

Figure 8A:
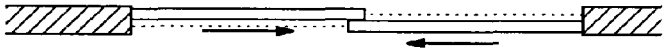
FIGS. 8A-8F show top views of typical panel systems with two panels.
Figure 8B:
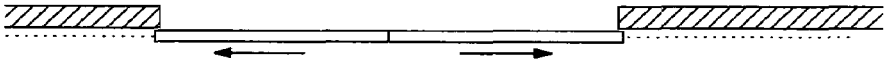
Figure 8C:
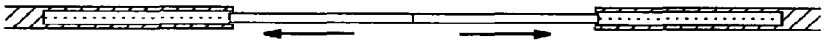
Figure 8D:
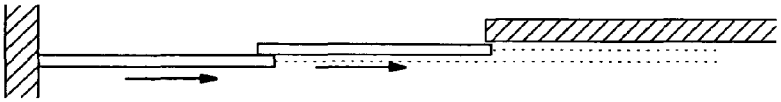
Figure 8E:
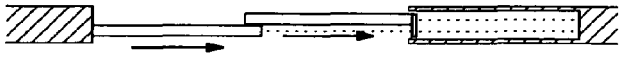
Figure 8F:
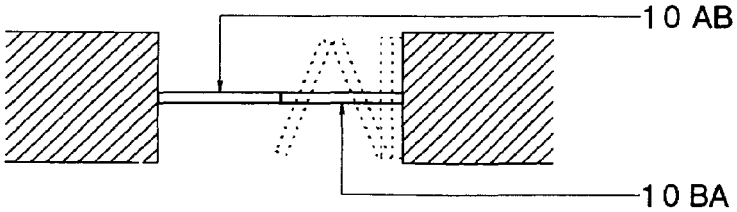

FIGS. 8A-8E show various similar configurations for two panel systems. FIG. 8F shows two panels 10AB, 10BA that are hinged to each other so that they can be folded.

Figure 9A:
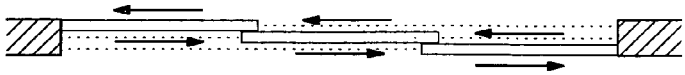
FIGS. 9A-9C show top views of typical panel systems with three panels.
Figure 9B:
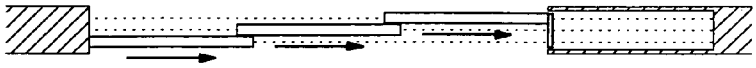
Figure 9C:
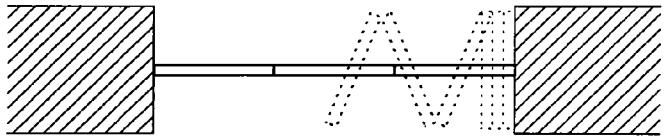

FIGS. 9A-9C show three-panel systems can slide with respect to each other, or can be folded (FIG. 9C).

Figure 10A:
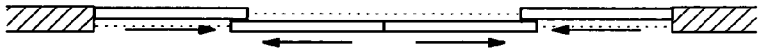
FIGS. 10A-10E show top views of typical panel systems with four panels.
Figure 10B:
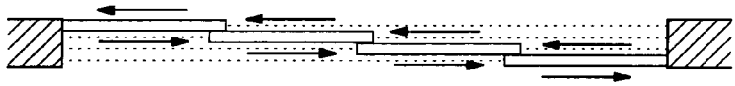
Figure 10C:
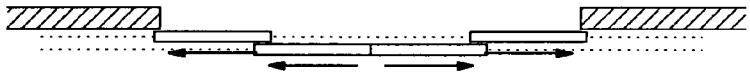
Figure 10D:
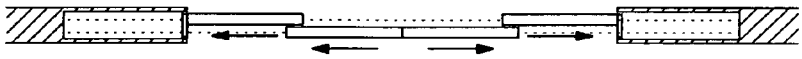
Figure 10E:
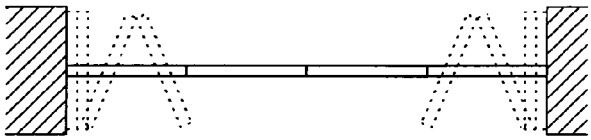

FIGS. 10A-10E show four-panel systems. The four panels can be connected end-to-end so that they can opened telescopically (FIG. 10B) all at once, or they are coupled two-by-two so that they can be opened from the center, either telescopically (FIGS. 10A, 10C, 10D) or by folding (FIG. 10E).

Figure 11:
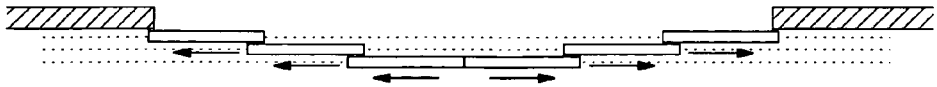
FIG. 11 show top views of a special panel system with six panels.

Finally, FIG. 11 shows a six-panel system that can be opened from the center.

The configurations shown in FIGS. 8-11 are provided merely as illustrative examples. Obviously, panels may be assembled in many other variations as well.

Figure 12D:
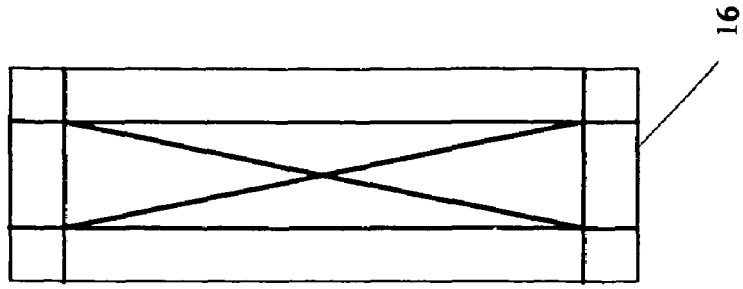
FIGS. 12A-C show three panels with three different designs, and FIG. 12D show the three designs superimposed.
Figure 12C:
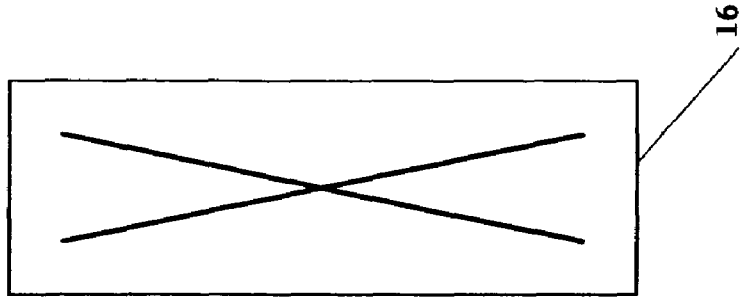
Figure 12B:
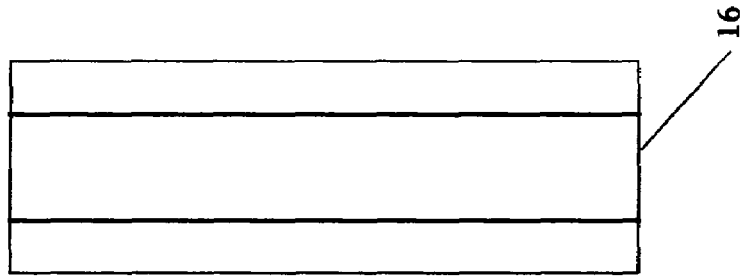
Figure 12A:
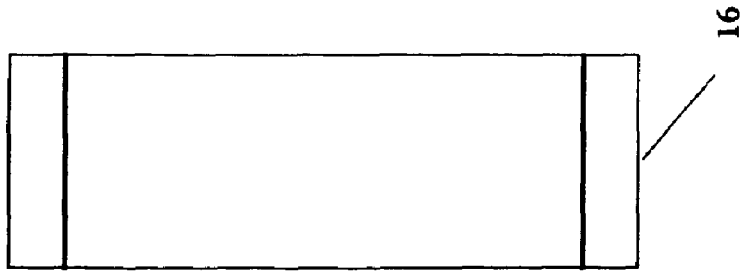

One of the advantages of the invention is that different esthetic designs can be achieved as the panels are opened and closed. For example, FIGS. 12A-12C show three different panels, each having a unique design as seen when the panels are disposed side by side. FIG. 12D show how, when the panels are in superimposed position, the three designs are also superimposed creating a new design.

As shown in FIG. 5, for at least some of the systems, the panels are provided with wheels that can engage stationary railings. Thus, the panels can be hung from the railings and moved back and forth, as desired. In addition, in some systems, other means are provided, if necessary to limit the lateral movement of the panels. These means may include floor channels disposed on the sides of the panels. The means may also include either a single elongated rail that extends into the groove 18. This embodiment, of course, is applicable only in configurations with panels that do not have stop or hook plates. In another embodiment, pins are provided in the panels that expand downwardly to engage a groove or other similar guide formed in the floor below the panels.

Obviously, numerous modifications may be made to this invention without departing from its scope as defined in the appended claims.

I claim:

1. A door system comprising:

a plurality of panels, each panel including a first frame, an intermediate member, and a second frame and means for sandwiching said intermediate member between said frames in an overlapping configuration, wherein said first and second frames and said intermediate member have respective frame and intermediate member edges around the sides, the intermediate member edges at least along some of the sides being flush with the frame edges, and wherein each panel has edges with said intermediate member being exposed through said edges;

means for installing said panels; and coupling means attached to said panels that allow said panels to be telescopically opened and closed, wherein said coupling means includes a set of hook plates and a set of stop plates mounted on said panels.

2. The system of claim 1 wherein said coupling means includes a set of hook plates and a set of stop plates mounted on said panels.

3. The system of claim 1 wherein said hook plates are arranged to selectively engage stop plates on an adjacent panel as said panels are moved.

4. The system of claim 1 wherein said coupling means are mounted on the bottom of the panels.

5. The system of claim 4 wherein said panels are made with grooves, said grooves being engaged by said hook plates.

6. The system of claim 1 wherein said intermediate member has decorative features selected to form one design with the doors in an opened position and another design when the panels are closed and superimposed.

7. The system of claim 1 wherein said intermediate member is selected from a transparent, translucent and opaque material.

8. The system of claim 7 wherein said intermediate member is a transparent plastic.

9. The system of claim 1 further comprising:

a hook plate for a panel having a bottom groove, said hook plate comprising:

a base shaped to be affixed to a panel and having an extension engaging an adjacent panel.

10. The system of claim 9 wherein said extension includes a member constructed and arranged to extend into said groove.

11. The system of claim 1 further comprising:

a plurality of joining rods extending through the holes in the intermediate member and having ends disposed in said first and second frames to join said frames together.

12. The system of claim 1, wherein said frames and said intermediate member have matching holes, said system further comprising dowels disposed in said holes and passing through said intermediate member for interlocking said frames and said intermediate members.

13. The system of claim 1 wherein along one side of one of said panels, .said intermediate member is recessed to form a groove said system further receiving a rail fitted in said groove for guiding a movement of said panel along said rail.

14. The system of claim 1 further comprising adhesion means for joining said frames and said intermediate member.

15. The system of claim 14 wherein said adhesion means includes double sided tape disposed between said frames and said intermediate member.

16. The system of claim 1 wherein said adhesion means includes holes in said frames and said intermediate member and complementary dowels fitted into said holes and passing through the intermediate member.

17. The system of claim 1 wherein said intermediate member of at least one of said panels is shorter on one side than the frames to form a groove.

18. A door system comprising:

a plurality of panels, each panel including a first frame, an intermediate member, and a second frame and means for sandwiching said intermediate member between said frames in an overlapping configuration, wherein said first and second frames and said intermediate member have respective frame and intermediate member edges around the sides, the intermediate member edges at least along some of the sides being flush with the frame edges, and wherein each panel has edges with said intermediate member being exposed through said edges;

means for installing said panels;

a hook plate for a panel having a bottom groove, said hook plate including a base shaped to be affixed to a panel and having an extension engaging an adjacent panel.

19. The system of claim 18 wherein said extension includes a member constructed and arranged to extend into said groove.

20. A door system comprising:

a plurality of panels, each panel including a first frame, an intermediate member, and a second frame and means for sandwiching said intermediate member between said frames in an overlapping configuration, wherein said first and second frames and said intermediate member have respective frame and intermediate member edges around the sides, the intermediate member edges at least along some of the sides being flush with the frame edges, and wherein each panel has edges with said intermediate member being exposed through said edges;

means for installing said panels; and a plurality of joining rods extending through the holes in the intermediate member and having ends disposed in said first and second frames to join said frames together.

21. A door system comprising:

a plurality of panels, each panel including a first frame, an intermediate member, and a second frame and means for sandwiching said intermediate member between said frames in an overlapping configuration, wherein said first and second frames and said intermediate member have respective frame and intermediate member edges around the sides, the intermediate member edges at least along some of the sides being flush with the frame edges, and wherein each panel has edges with said intermediate member being exposed through said edges;

means for installing said panels; and wherein along one side of said panel, said intermediate member is recessed to form a groove said system further receiving a rail fitted in said groove for guiding a movement of said panel along said rail.

* * * * *